United States Patent [19]

Aaberg

[11] 4,043,257

[45] Aug. 23, 1977

[54] METHOD AND APPARATUS FOR EXHAUSTING AIR FROM A LIMITED ZONE

[76] Inventor: Carl Peter Noe Aaberg, Christiansgade 1, 7500 Holstebro, Denmark

[21] Appl. No.: 637,402

[22] Filed: Dec. 3, 1975

[30] Foreign Application Priority Data

Dec. 4, 1974 Denmark ..... 6301/74

[51] Int. Cl.[2] ..... F24F 7/00

[52] U.S. Cl. ..... 98/43 R; 98/115 LH; 55/DIG. 18

[58] Field of Search ..... 98/32, 37, 42 R, 33 R, 98/36, 115 R, 115 LH, 43 R; 126/121; 55/DIG. 18

[56] References Cited

U.S. PATENT DOCUMENTS 3,557,681 1/1971 Kristiansen ..... 98/33 R

*Primary Examiner*—Ronald C. Capossela

*Attorney, Agent, or Firm*—Kenyon & Kenyon

[57] ABSTRACT

Exhaust from a limited zone lying on the axis of a cylindrical exhaust duct and spaced from an unobstructed entrance opening of the duct is produced by injecting a flow of air radially outward from a circumferentially extending aperture surrounding the entrance to the exhaust duct while at the same time sucking air through the unobstructed opening of the exhaust duct.

5 Claims, 1 Drawing Figure

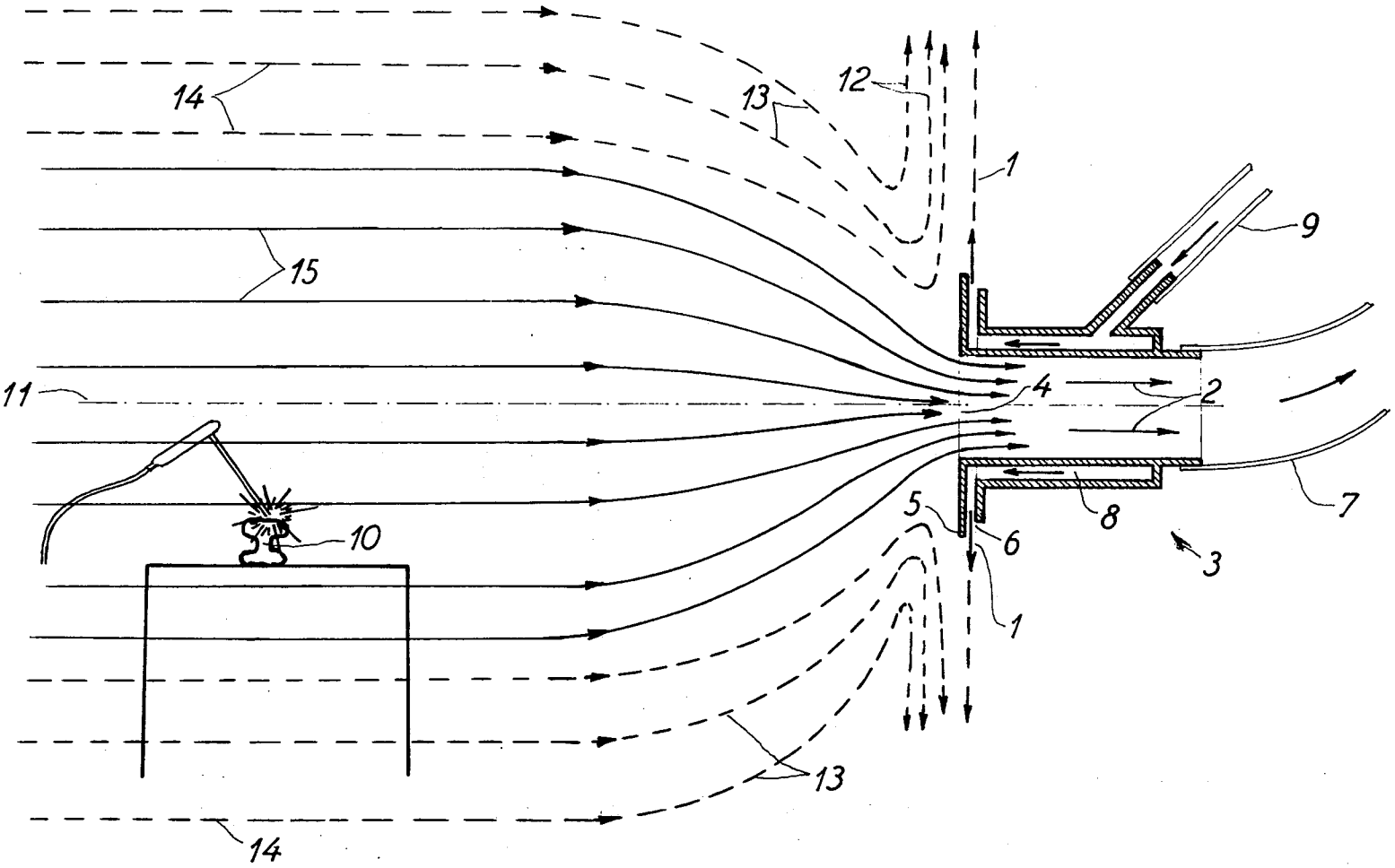
9
7
2
3
8
4
1
6
1
5
12
13
13
10
15
14
14
11

METHOD AND APPARATUS FOR EXHAUSTING AIR FROM A LIMITED ZONE

BACKGROUND OF THE INVENTION

The invention relates to a method for exhausting from a limited zone and an exhaust fan apparatus for the exercise of the method.

Methods so far known for the exhaustion of places of work are based on an exhaustion of the room air by means of an exhaustion device placed in a farther or lesser distance from the place of work. Such an exhaustion device is not very expedient as it first of all must have comparatively great suction capacity in order to be effective, which great capacity causes air currents with great speed from all of the room towards the exhaustion place. This draft is very unhealthy for the personnel staying near the place being exhausted. Furthermore there will be a great loss of heat caused by this vigorous exhaustion of heated air.

In order to improve the efficiency it is known to supplement the exhaustion with injection of air, which injection is done from an area near the exhaustion and directed towards the place of exhaustion. This injection causes an entrainment effect on the room air which thereby creates the flow directed towards the exhaustion. This improves the suction effect but not the unpleasant air currents and the uncontrolled exhaustion of all of the air space in front of the exhaustion.

In order to exhaust from as limited a zone as possible it has been necessary to do the exhaustion close to the individual places of work. This is in practice quite inexpedient as it considerably reduces the freedom of action around the place of work because of the presence of the exhaustion device.

The purpose of this invention is to overcome the defects and inconveniences in the known methods. This purpose is achieved by injecting a flow of air radially outward from a circumferential region surrounding the unobstructed entrance to an exhaust duct in proportion to the exhaustion at the same time of air through the exhaust duct.

Hereby a constant exhaustion with great effect is obtained which is constant within wide limits, as the exhaustion is only taking place from a limited zone along the axis of symmetry of the exhaust duct because of the entrainment effect which has been generated by the radial flow. Hereby one avoids having to suck from all of the room. This causes the exhaustion to work with great speed even far from the exhaust duct opening. The resulting concentrated exhaustion has great effect because of the limited zone of exhaustion which can be facing as needed. Hereby the loss of heat is considerably reduced and also there will be almost no perception of draft as the major portion of air will not be exhausted but remain in the room. Furthermore, the polluted air from the work space remains inside the zone of exhaustion as it does not pass the boundary surface between the exhausted amount of air and the entrained amount of air.

A nozzle comprising a cylindrical exhaust duct surrounded at its entrance end by a pressure chamber having a circumferential aperture is especially appropriate for exercise of the method. It is simple and compact without mechanical parts and it has in practice shown to function as an effective exhaustion nozzle.

The invention will in the following be further described in detail, referring to the drawing which shows an exhaust nozzle seen from the longitudinal section and with the streamlines drawn in.

The exhaust nozzle 3 is built up with a central exhaust opening 4 which is connected up to an exhaust fan (not shown) by a hose 7. Around the exhaust opening there is a pressure chamber 8 which is connected up to a source of pressure by a pressure (not shown) hose 9. This chamber 8 opens into an injection aperture 6 which either lies along the entire rim or along a part of it, and which directs a planar flow of air at right angles to the axis of symmetry 11 of the exhaust opening 4. The place of work is indicated as a welding table with a subject matter 10 which is being electrically welded.

The method will hereafter be described. By injection of air through the injection aperture 6 a planar flow of air radially outward is produced. The planar outward flow 1 causes an entrainment effect on the room air which near the aperture 6 is directed parallel to the radial flow 1. The dashed streamlines of recirculating air in the region 12 adjacent to and radially outward from injection aperture 6 lie close to each other in order to illustrate great speed. At some distance from the jet the streamlines of recirculating air at region 13 are directed inward towards the aperture 6 as the effect is biggest at the mouth of the aperture. A further distance from the jet the streamlines of recirculating air at region 14 have a direction at right angles to the radial flow 1, and the distance between the streamlines 14 has been increased in order to illustrate the reduced speed.

At the same time as the planar flow of air is being injected, an exhaustion is taking place through the exhaust opening 4. The solid streamlines 15 of air being exhausted are shown squeezed within the dashed streamlines of recirculating air in regions 13, 14 to illustrate the entrainment effect. The exhaustion will therefore be limited to the zone around the axis of symmetry 11. They are therefore parallel at a distance from the exhaust opening 4, and immediately in front of this they squeeze inward towards the opening.

This causes the great suction effect which is constant because the exhaustion is limited to the zone around the axis of symmetry 11, which zone does not expand significantly with distance increasing from the nozzle 3. There has thus been produced, in effect, a compact nozzle which is able to exhaust over large distances, as the suction effect is constant in the long zone of exhaustion.

In practice, the described position and direction of the streamlines has been determined to be very constant for large changes in the injected and exhausted amount without changing essentially. The exhaust nozzle 3 may have any geometrical form in cross section, and the rim aperture 6 may be limited to a part of the rim 5 in order thereby to produce a desired cross section of the zone of exhaustion. Furthermore an adjustment to shape of room, walls, screens and the like is imaginable which determines a special design of the exhaust nozzle.

I claim:

1. A method for exhausting fluid from a limited zone around an axis extending into an open space at right angles from the plane of an exhaust opening comprising:

sucking fluid from an open space through an unobstructed exhaust opening facing said space and simultaneously injecting a circumferentially extending flow of fluid into the open space radially outward from a source surrounding and adjacent to the exhaust opening.

2. The method of claim 1 wherein the flow rate of injected fluid is in proportion to the flow rate of exhausted fluid.

3. A device for exhausting fluid from a limited zone around an axis extending into an open space, the device comprising:

a cylindrical duct having an unobstructed entrance opening at one end and adapted to be connected to a suction source at the other end and a pressure chamber surrounding the duct adjacent to said one end, the pressure chamber having an inlet adapted to be connected to a source of fluid under pressure and a circumferentially extending outlet aperture located adjacent to the plane of the entrance opening of the duct for directing a flow of fluid radially outward from the pressure chamber, whereby said flow of injected fluid will entrain fluid from an open space in front of the entrance opening to cause exhaustion of fluid from a limited zone along an axis extending into the open space perpendicular to the plane of the entrance opening.

4. The device of claim 3 wherein the circumferentially extending aperture extends at least part way around the periphery of the pressure chamber.

5. The device of claim 3 wherein the circumferentially extending aperture extends around the entire circumference of the pressure chamber.

* * * * *

UNITED STATES PATENT AND TRADEMARK OFFICE

CERTIFICATE OF CORRECTION

PATENT NO. : 4,043,257
DATED : August 23, 1977
INVENTOR(S) : Carl Peter Noe Aaberg It is certified that error appears in the above-identified patent and that said Letters Patent are hereby corrected as shown below:

Col. 1, line 15 - between "have" and "comparatively" insert --a--.

Col. 1, line 59 - change "space" to --place--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*